United States Patent [19]

Kumasaka

[11] 4,092,169

[45] May 30, 1978

[54] ANODIZED ALUMINUM PHOTOGRAPHIC PLATES WITH SILVER BROMIDE IN PORES OF OXIDE LAYER, AND PROCESS OF MANUFACTURE THEREOF

[75] Inventor: Isao Kumasaka, Odawara, Japan

[73] Assignee: Fuji Photo Film Co., Ltd., Minami-ashigara, Japan

[21] Appl. No.: 450,509

[22] Filed: Mar. 12, 1974

Related U.S. Application Data

[63] Continuation of Ser. No. 231,000 Mar. 1, 1972

[30] Foreign Application Priority Data

Mar. 1, 1971 Japan ..... 46-10509

[51] Int. Cl.[2] ..... G03C 1/94

[52] U.S. Cl. ..... 96/86 R; 96/94 R; 96/94 BF; 148/6.27; 204/58

[58] Field of Search ..... 96/86 R, 94, 94 BF; 204/17, 58; 148/6.27

[56] References Cited

U.S. PATENT DOCUMENTS

| | | | |
|---|---|---|---|
| 2,115,339 | 4/1938 | Mason | 96/86 R |
| 2,126,017 | 8/1938 | Jenny et al. | 96/86 R |
| 2,598,043 | 5/1952 | Eichner | 148/6.27 |
| 2,766,119 | 10/1956 | Freedman et al. | 96/86 R |
| 2,995,443 | 8/1961 | Kempe | 96/86 R |
| 3,250,215 | 5/1966 | Evershein et al. | 101/459 |
| 3,275,440 | 9/1966 | Kempe et al. | 96/66 |
| 3,511,661 | 5/1970 | Rauner et al. | 96/86 R |
| 3,615,553 | 10/1971 | Wainer | 96/86 R |
| 3,776,734 | 12/1973 | Kumasaka | 96/86 R |
| 3,811,894 | 5/1974 | Yonezawa et al. | 96/86 R |

OTHER PUBLICATIONS

Botosan, R., "Plating", 5/1968, pp. 444–448.

Miller et al., "IBM Tech. Discl. Bulletin", vol. 14, No. 1, p. 22, 6/1971.

Mees et al., "The Theory of the Photographic Process", 3rd Ed., 1966, pp. 31–32.

*Primary Examiner*—Charles L. Bowers, Jr.

*Attorney, Agent, or Firm*—Sughrue, Rothwell, Mion, Zinn and Macpeak

[57] ABSTRACT

An improved photographic element having high photosensitivity, which element comprises an anodized aluminum plate as a support having silver halide adsorbed in the pores of the oxide layer on the surface of said plate. The improvement comprises adding aqueous ammonia to a solution of silver nitrate used in forming said silver halide, the amount of aqueous ammonia being sufficient to raise the photosensitivity of the element.

14 Claims, No Drawings

ANODIZED ALUMINUM PHOTOGRAPHIC PLATES WITH SILVER BROMIDE IN PORES OF OXIDE LAYER, AND PROCESS OF MANUFACTURE THEREOF

This is a continuation, of application Ser. No. 231,000 filed Mar. 1, 1972.

BACKGROUND OF THE INVENTION

1. Field of the Invention:

This invention relates to photosensitive elements having high sensitivity. More particularly the invention relates to an anodized aluminum or aluminum alloy plate as a support having silver halide contained in the pores of an oxide layer formed on the surface of said plate.

2. Description of the Prior Art:

Heretofore, silver salt photographic elements utilizing an anodized aluminum have been well known and are described, for example, in U.S. Pat. Nos. 2,115,339, 2,126,017 and 2,766,119.

Many reports have also been made as to the aluminum oxide layer (hereinafter referred to as alumite for convenience) formed on the surface of the aluminum by anodic oxidation, and in particular a detailed explanation as to the structure thereof is made in J. Elec. Chem. Society, 100, (9), 411.

This alumite layer is composed of hexagonal prism units (cells) standing vertically on the surface of the aluminum. A pore generally of 100 to 1,000 A in size is present in the central portion of each cell.

The predominant characteristic of such silver salt photographic elements using an anodized aluminum plate consists in durability inherent to the alumite layer due to its corrosion resistance and as a result the silver image can be protected, giving thereby semi-permanently storageable image recordings.

Therefore, it becomes necessary not only to simply place the photosensitive silver salt on the alumite layer, but to incorporate the silver salt into the pores of the alumite layer.

Silver halides, which are conventionally known photographic light-sensitive materials, are prepared, as is well known, by reacting silver nitrate with an alkali metal halide, in a gelatin solution. The resulting silver halide grains are ripened and while keeping the ripening temperature at a given temperature level by warming, the silver halide grains grow with the result thereby being that their photosensitivity is enhanced. It is known that, when the silver halide grains are prepared without the aid of any particular chemicals, their photosensitivity will depend upon the size of the silver halide grains, i.e. those grains of a smaller grain size will give relatively low photosensitivity. The grain size of silver halides used in photographic light-sensitive elements and prepared in the conventional manner will be within the range of from about 0.1 to 1.0 micron.

In contrast to this, the light-sensitive silver salts to be formed in the pores of an alumite layer are required to be of the grain size below about 1,000 A (0.1 micron). Therefore, silver salt containing photographic aluminum plates obtained by heretofore known methods are low in photosensitivity. Due to their low photosensitivity, they cannot possibly be used in making an enlargement from a small negative and, even when the image is formed using contact printing, they will require an exposure time on the order of several tens of seconds.

SUMMARY OF THE INVENTION

An object of the present invention is therefore to provide photosensitive aluminum plates having high sensitivity. Another object of the present invention is to provide photosensitive aluminum plates which can be used satisfactorily as photosensitive materials for enlargement. Another object of the present invention is to provide a method for preparing such photosensitive aluminum plates.

I have now found that the photosensitivity of a light-sensitive silver salt formed in the pores of an oxide film on the surface of an anodized aluminum plate as a support can be enhanced by impregnating said pores with a solution of silver nitrate which is used in the formation of said silver salt, to which solution aqueous ammonia has been added in an amount sufficient to raise the photosensitivity, or preferably until no more precipitation takes place (i.e., until the formed silver oxide precipitate formed initially due to ammonia addition just disappears and redissolves). Then, after subsequent drying of the support, the support is impregnated with a solution of a halide. It should be noted that the present invention is distinguished from conventional methods of producing silver halide photographic emulsions in that, in the present invention, the solution of silver nitrate containing the aqueous ammonia is dried once and subsequently brought into contact with the solution of a soluble halide.

DETAILED DESCRIPTION OF THE INVENTION

Examples of silver halides which may be used in the present invention include silver bromide, silver chloride and mixed silver halides, i.e., silver chlorobromide, although silver bromide is particularly preferred.

The hydrophilic colloids which may be used as binders for the silver halides according to the invention include e.g., gelatin and derivatives thereof, polyvinyl alcohol, methyl cellulose, and gum arabic. The amount of binder which is generally used ranges from about 0.1 to 1%, preferably from about 0.2 to 0.5% by weight based on the silver solution or the halide solution.

Aluminum plates which may be used in the present invention may be made of substantially pure aluminum or aluminum alloyed with zinc, iron, silicon and copper, although copper is particularly preferred. The photosensitivity of photosensitive aluminum plates obtained according to the present invention is raised as much as ten to twenty times the photosensitivity of those plates obtained without using the aqueous ammonia, and moreover, the present photosensitive aluminum plates can be satisfactorily used as photosensitive materials for making enlargements at exposure time levels of the order of several ten seconds. The amount of alloying metal can range from about 0.05 to 1.0% preferably from about 0.12 to 0.3% by weight.

Suitable halide solutions which can be used are alkali metal halide solutions.

The present invention will be illustrated by reference to the following example, which is not intended to thereby limit the scope of the present invention.

EXAMPLE

A corrosion resistant aluminum alloy plate containing 0.20% copper was anodized in an electrolytic solution containing 3% of potassium oxalate and 5% of oxalic acid by impressing upon the aluminum alloy plate as the anode a direct current of 2 A/dm². for a period of 30 minutes, while maintaining the temperature of the solution at 60° C. After washing and drying the plate, the pores of the aluminum oxide layer formed on the plate by anodic oxidation were impregnated with a solution of silver nitrate of the following composition, by applying the silver nitrate solution to the plate and subsequently drying the plate.

| | | |
|---|---|---|
| Silver Nitrate | 300 | g |
| Gelatin | 5 | g |
| Concentrated Aqueous Ammonia (28% by weight solution) | 260 | cc. |
| Distilled water to make 1 liter | | |

The thus impregnated pores were further impregnated with a solution of a halide of the following composition by applying the solution to the plate, to thereby form therein a silver halide. This was followed by a washing with water for 30 seconds and then by drying.

| | | |
|---|---|---|
| Potassium Bromide | 100 | g |
| Potassium Ferricyanide | 25 | g |
| Distilled water to make 1 liter | | |

The photosensitivity of the thus obtained photosensitive aluminum plate as expressed, for convenience, by the JIS K 7611 method, in comparison with a conventionally prepared aluminum photographic plate not employing the aqueous ammonia in the silver nitrate solution is indicated in the following Table 1.

Table 1

| | Solution of Silver Nitrate Used | Photosensitivity of the Photosensitive Aluminum Plate |
|---|---|---|
| The Prior Art Method | Not Containing Aqueous Ammonia | 1 – 2 |
| The Method of the Invention | Containing Aqueous Ammonia | 10 – 25 |

As is evident from the results contained in Table 1, the photosensitivity of the photosensitive aluminum plate prepared according to the invention increased approximately ten times that of the photosensitive aluminum plate prepared using a prior art technique. The photosensitive aluminum plate of the invention, when enlarged 2 – 4 times (4 – 16 times in area ratio), could be used satisfactorily at exposure times of the order of 20 to 40 seconds.

From the foregoing experimental data, it will be appreciated by those skilled in the art that an outstanding technical advance has been made and markedly improved results have been obtained in accordance with the present invention.

The invention has been described in considerable detail with particular reference to preferred embodiments thereof, but it will be understood that variations and modifications can be effected without departing from the spirit and scope of the invention as described hereinabove and as defined in the appended claims.

What is claimed is:

1. In a method for manufacturing a photographic element of improved photosensitivity comprising applying a solution of silver nitrate to an anodized aluminum plate having an oxide layer containing pores therein on the surface of said plate and then applying a solution of an alkali metal bromide to said aluminum plate to incorporate silver bromide into the pores of said oxide layer, the improvement which comprises said solution of silver nitrate containing additionally aqueous ammonia in an amount such that the silver oxide precipitate initially formed just redissolves and disappears.

2. The method as claimed in claim 1, in which said silver nitrate solution contains a hydrophilic binder.

3. The method as claimed in claim 2, in which said binder is selected from the group consisting of gelatin and derivatives thereof, polyvinyl alcohol, methyl cellulose and gum arabic.

4. The method as claimed in claim 3, in which said binder is gelatin.

5. The method as claimed in claim 2, wherein the amount of said hydrophilic binder is from 0.1 to 1% based on the amount of said silver nitrate solution.

6. The method as claimed in claim 1 in which said aluminum plate is substantially pure aluminum.

7. The method as claimed in claim 1, in which said aluminum plate is an aluminum-copper alloy containing from about 0.05 to 1.0 percent by weight copper.

8. The photosensitive material comprising an anodized aluminum plate, said anodized layer containing a photosensitive silver bromide in the pores of said layer, prepared by the process of claim 1.

9. The photosensitive material as claimed in claim 8, in which said silver nitrate solution contains a hydrophilic binder.

10. The photosensitive material as claimed in claim 9, in which said binder is selected from the group consisting of geletin and derivative thereof, polyvinyl alcohol, methyl cellulose and gum arabic.

11. The photosensitive material as claimed in claim 10, in which said binder is gelatin.

12. The photosensitive material as claimed in claim 9, wherein said hydrophilic binder is present in an amount between 0.1 and 1% based on the amount of said silver nitrate solution.

13. The photosensitive material as claimed in claim 8, in which aluminum plate is substantially pure aluminum.

14. The photosensitive material as claimed in claim 8, in which said aluminum plate is an aluminum-copper alloy containing from about 0.05 to 1.0 percent by weight copper.

* * * * *